US007810280B2

(12) United States Patent
Hattori et al.

(10) Patent No.: US 7,810,280 B2
(45) Date of Patent: Oct. 12, 2010

(54) AUTOMATIC OPENING/CLOSING APPARATUS FOR VEHICLE

(75) Inventors: Takeshi Hattori, Wako (JP); Ryoji Araki, Wako (JP); Osamu Sera, Wako (JP); Masashi Shimizu, Nirasaki (JP); Yasushi Yoshida, Kiryu (JP)

(73) Assignees: Honda Motor Co., Ltd., Tokyo (JP); Mitsui Mining and Smelting Co., Ltd., Tokyo (JP); Mitsuba Corporation, Kiryu-shi (JP)

( * ) Notice: Subject to any disclaimer, the term of this patent is extended or adjusted under 35 U.S.C. 154(b) by 1080 days.

(21) Appl. No.: 11/058,556

(22) Filed: Feb. 15, 2005

(65) Prior Publication Data

US 2005/0177977 A1 Aug. 18, 2005

(30) Foreign Application Priority Data

Feb. 16, 2004 (JP) ..... 2004-037939

(51) Int. Cl.
*E05F 15/00* (2006.01)

(52) U.S. Cl. ..... 49/340; 49/341; 49/342; 49/345

(58) Field of Classification Search ..... 49/339, 49/340, 341, 342, 344, 345, 346; 296/146.6, 296/56, 146.8
See application file for complete search history.

(56) References Cited

U.S. PATENT DOCUMENTS

| | | | | |
|---|---|---|---|---|
| 1,614,416 | A * | 1/1927 | Whidden | 296/96.2 |
| 6,092,337 | A | 7/2000 | Johnson et al. | 49/340 |
| 6,142,551 | A | 11/2000 | Ciavaglia et al. | 296/56 |
| 6,318,025 | B1 | 11/2001 | Sedlak | 49/341 |
| 6,425,205 | B2 | 7/2002 | Wygle et al. | 49/349 |
| 6,637,157 | B1 * | 10/2003 | Dombrowski et al. | 49/341 |
| 2001/0033086 | A1 | 10/2001 | Yuge et al. | 296/56 |
| 2005/0017539 | A1 * | 1/2005 | Ihashi et al. | 296/146.8 |

FOREIGN PATENT DOCUMENTS

| | | |
|---|---|---|
| JP | 2001280000 | 10/2001 |
| JP | 2005-053470 | 3/2005 |

* cited by examiner

*Primary Examiner*—Gregory J. Strimbu
(74) *Attorney, Agent, or Firm*—McCormick, Paulding & Huber LLP

(57) ABSTRACT

The force from a drive rod driven by an electric motor is transmitted via a link arm pivotally linked to the drive rod and a back door. When the back door is operated in an open direction, the link arm is supported by an open-side support slider and the acting direction of the force applied to the link arm by the drive rod is shifted to the opening direction of the back door. When the back door is operated in a closing direction, the link arm is supported by a closed-side support slider and a closed-side support roller and the acting direction of the force applied to the link arm by the drive rod is shifted to the closing-direction of the back door. The open-side and closed-side support sliders are pressed against the link arm by leaf spring members so that the link arm is prevented from oscillating between the sliders.

2 Claims, 7 Drawing Sheets

AUTOMATIC OPENING/CLOSING APPARATUS FOR VEHICLE

CROSS-REFERENCE TO RELATED APPLICATION

The present application claims priority from Japanese Patent Application No. JP 2004-37939 filed on Feb. 16, 2004, the content of which is hereby incorporated by reference into this application.

TECHNICAL FIELD OF THE INVENTION

This invention relates to an automatic opening/closing apparatus to be used for a vehicle for the purpose of automatically opening/closing an opening/closing member attached to a vehicle by way of hinges.

BACKGROUND OF THE INVENTION

Vehicles including automobiles are provided at different portions thereof with doors, a trunk lid, a back door and other opening/dosing members that are attached to the vehicle by way of hinges. Particularly, many vans and station wagons are provided with a back door at the outer end of the vehicle for the ease of access when loading and unloading cargoes.

Normally, such a back door is attached to the vehicle by way of hinges that are rigidly secured to the rear end of the roof of the vehicle to allow the door to turn around an axis of rotation that is substantially horizontal so as to allow the back door swing up and down around the hinges. The back door is also referred to as lift gate or rear hatch because it swings fully upward from the vehicle body when it is operated.

Since back doors are mostly large and heavy, women and children often feel it difficult to open and close the back door. Particularly, since the back door swings fully upward when it is operated, it may be highly difficult for women and children to open and close it.

Under the current circumstances where station wagons and other cars for family use are increasing, some vehicles are provided with an automatic opening/closing apparatus for automatically opening/closing the back door so as to allow women and children to open and close it without difficulty. Since such an automatic opening/dosing apparatus can be remotely controlled from the driver's seat to open and dose the back door, there is a considerable demand for such automatic opening/dosing apparatuses to be attached to vehicles because of the convenience they provide.

As known automatic opening/dosing apparatuses, for example, as shown in Japanese Patent Application Laid-Open Publication No. 2001-280000, an actuator unit that is typically driven to operate by an electric motor or the like is arranged in the roof of a vehicle and the force output from the actuator unit is transmitted to the back door by way of a link mechanism to open and dose a back door. The actuator unit is of the so-called rack and pinion type and force is output from the electric motor to realize a linear reciprocating motion of the rack by way of the pinion. The rack can freely swing around the rotary axis of the pinion relative to the vehicle and move along a direction inclined relative to the vertical direction of the vehicle. On the other hand, a link arm that is curved around the pivot of the hinge is rigidly secured to the back door at an end thereof and the rack is linked to the other end of the link arm by means of a coupling pin. As the electric motor is driven, the linear reciprocating motion of the rack is converted into an opening/closing motion of the back door by way of the link arm, so that the back door is opened and closed.

However, of such an opening/closing apparatus, the link arm is rigidly secured to the back door so that the load of the back door when being opened or dosed is concentratively applied to the base part of the link arm so that the link arm has to be rigidly secured to the back door to show an enhanced strength. There has been proposed an arrangement where the link arm is coupled to the back door in such a way that it can swing freely to prevent the load from being concentratively applied to the base part of the link arm, thereby avoiding the above identified problem. With this arrangement, since the link arm can freely swing relative to the vehicle in addition to the rack, the link arm has to be supported so as to make it to be directed in a predetermined direction that can vary depending on the direction along which the door is being opened or closed in order to convert the linear reciprocating motion of the rack into an opening/closing motion of the back door by way of the link arm.

Although not publicly known, there is a technique of arranging a pair of support members arranged opposite to each other with the link arm interposed between them at the side of the actuator unit and another pair of support members arranged opposite to each other with the link arm interposed between them at the side of the back door so that the link arm may be moved to open and close the back door by means of the support members. Sliders, rollers or the like that can slide relative to the link arm are used as support members so that the load applied to the link arm is borne by selected ones of the support members depending on the direction of application of the load to consequently define the direction of application of the force being applied to the link arm by the rack and move the link arm to open and close the back door.

SUMMARY OF THE INVENTION

In an opening/dosing apparatus of the above described type, each of the support members has a function of bearing the load being applied to the link arm by the rack and converting the direction of application of force of the rack. A predetermined gap is provided between each of the support members and the link arm. On the other hand, since the rack can move as backlash for a distance defined by the rack and the pinion even if the electric motor is not in operation so that the link arm can swing to a certain extent around the link shaft at the side of the back door.

Therefore, if the vehicle is subjected to vibrations when the back door is dosed, the link arm also vibrates around the link shaft of the back door between the support members to give rises to collision noises as it collides with the support members.

It is an object of the present invention to reduce the noises that are generated by the automatic opening/closing apparatus of a vehicle by suppressing the vibrations of the link member that is linked to the back door and can swing freely.

According to the invention, there is provided an automatic opening/closing apparatus to be used for a vehicle in order to automatically open and dose an opening/closing member attached to the vehicle by way of a hinge, the apparatus comprising: a link member linked to the opening/closing member so as to be able to freely swing; an output member linked to the link member so as to be able to freely swing and incline relative to the vehicle; a drive source for driving the opening/closing member to be opened and dosed by reciprocating the output member; an open side support member for bearing the load applied to the link member when the opening/closing member is driven to become opened by the drive source and shifting the acting direction of the force being applied by the drive source to the opening direction of the opening/closing member; a dosed side support member for bearing the load applied to the link member when the opening/closing member is driven to become closed by the drive source and shifting the acting direction of the force being applied by the drive source to the closing direction of the opening/dosing member; and a press member for pressing the link member to the open side support member or the closed side support member when the opening/dosing member is at the fully dosed position.

Preferably, in an automatic opening/dosing apparatus to be used for a vehicle according to the invention, the link member is formed to show a curved and arm-shaped profile.

Preferably, in an automatic opening/dosing apparatus according to the invention, the apparatus comprises a first open side support member arranged at the side of the drive source and at a side of the link member as viewed in the swinging direction of the link member; a first dosed side support member arranged oppositely relative to the first open side support member with the link member interposed between the two support members; a second open side support member arranged closer to the opening/closing member relative to the first open side support member and at the opposite side of the link member as viewed in the swinging direction of the link member; and a second dosed side support member arranged oppositely relative to the second open side support member with the link member interposed between the latter two support members.

Preferably, in an automatic opening/dosing apparatus to be used for a vehicle according to the invention, at least either the first open side support member or the first closed side support member is pressed against and held in contact with the link member.

Preferably, in an automatic opening/dosing apparatus to be used for a vehicle according to the invention, at least either the first open side support member or the first closed side support member is urged by a leaf spring rigidly secured to the vehicle and held in contact with the link member.

Preferably, in an automatic opening/dosing apparatus to be used for a vehicle according to the invention, the press member is arranged closer to the drive source relative to the first dosed side support member and the link member is pressed against the first open side support member by the press member.

Preferably, in an automatic opening/dosing apparatus to be used for a vehicle according to the invention, the press member is provided with a resilient body rigidly secured to the vehicle and a ring member arranged to tightly surround the resilient member and the ring member is held in contact with the link member with the resilient body in a resiliently deformed condition when the opening/closing member is at the fully closed position.

Thus, according to the invention, when the opening/closing member is at the fully closed position, the link member is pressed against either the open side support member or the dosed side support member so that the collision noises or the like that arise when the link member swing between the open side support member and the closed side support member are suppressed to reduce the noises of the automatic opening/closing apparatus to be used for a vehicle.

Additionally, according to the invention, since at least the first open side support member or the first closed side support member arranged at the side of the drive source is pressed against and held in contact with the link member, the link member is reliably prevented from oscillating.

Still additionally, according to the invention, the press member is arranged closer to the drive source relative to the first dosed side support member, the link member is reliably pressed against the first open side support member by the pressure applied by the press member. Therefore, oscillations of the link member are more reliably suppressed to by turn reliably reduce the noises of the automatic opening/closing apparatus to be used for a vehicle.

BRIEF DESCRIPTIONS OF THE DRAWINGS

DESCRIPTION OF THE PREFERRED EMBODIMENTS

Now, the present invention will be described by referring to the accompanying drawings that illustrate a preferred embodiment of the invention.

Figure 1:
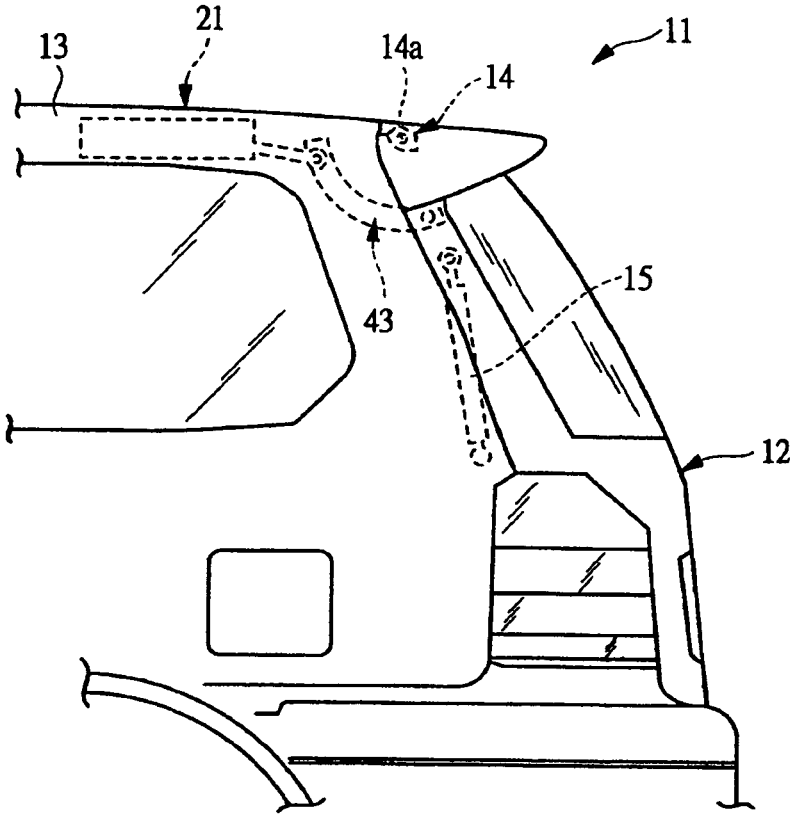
FIG. 1 is a schematic lateral view of a rear end part of a vehicle equipped with a first embodiment of automatic opening/dosing apparatus to be used for a vehicle according to the invention.
Figure 2:
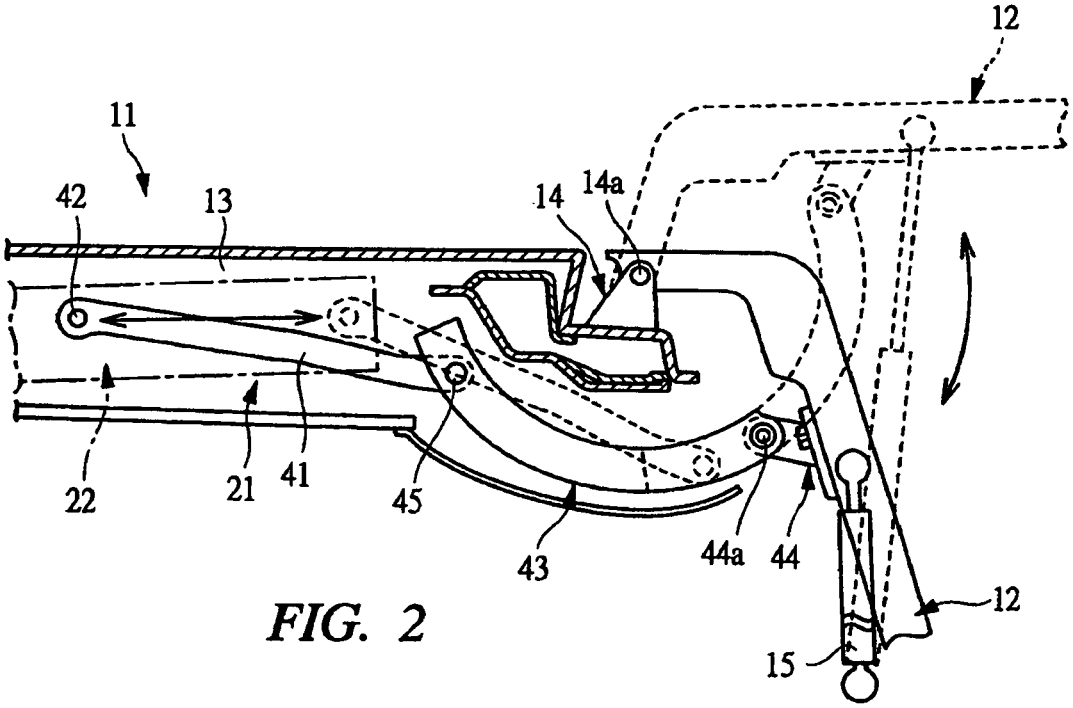
FIG. 2 is a schematic cross sectional view of a principal part of the vehicle of FIG. 1.

FIG. 1 is a schematic lateral view of a rear end part of a vehicle equipped with the first embodiment of automatic opening/closing apparatus to be used for a vehicle according to the invention and FIG. 2 is a schematic cross sectional view of a principal part of the vehicle of FIG. 1.

As shown in FIGS. 1 and 2, the vehicle 11 is provided at the rear end thereof with a back door 12 that is an opening/dosing member. The back door 12 is attached to the vehicle 11 by way of a hinge 14 that is rigidly secured to the rear end of the roof 13 of the vehicle 11 and adapted to turn around the central axis 14*a* of revolution of the hinge 14 by about 90 degrees between a fully closed position indicated by solid lines in FIG. 2 and a fully open position indicated by broken lines in FIG. 2.

A gas stay 15 is arranged between the vehicle 11 and the back door 12 to assist the opening/closing operations of the back door 12. When the back door 12 is opened substantially by half, the urging force of the gas stay 15 is balanced by its own weight to hold the back door 12 to the intermediary position. When the back door 12 is opened more from the intermediary position, the gas stay 15 urges the back door 12 to become opened still further. When, on the other hand, the back door 12 is opened less from the intermediary position, the urging force of the gas stay 15 falls below its own weight so that it contracts as the back door 12 is closed. Note, however, that the gas stay 15 may be omitted for the purpose of the present invention.

The vehicle 11 is equipped with an automatic opening/dosing apparatus 21 to be used for a vehicle according to the invention (to be referred to as opening/closing apparatus 21 hereinafter) so that the back door 12 can be opened and closed automatically by means of the opening/dosing apparatus 21.

Figure 3:
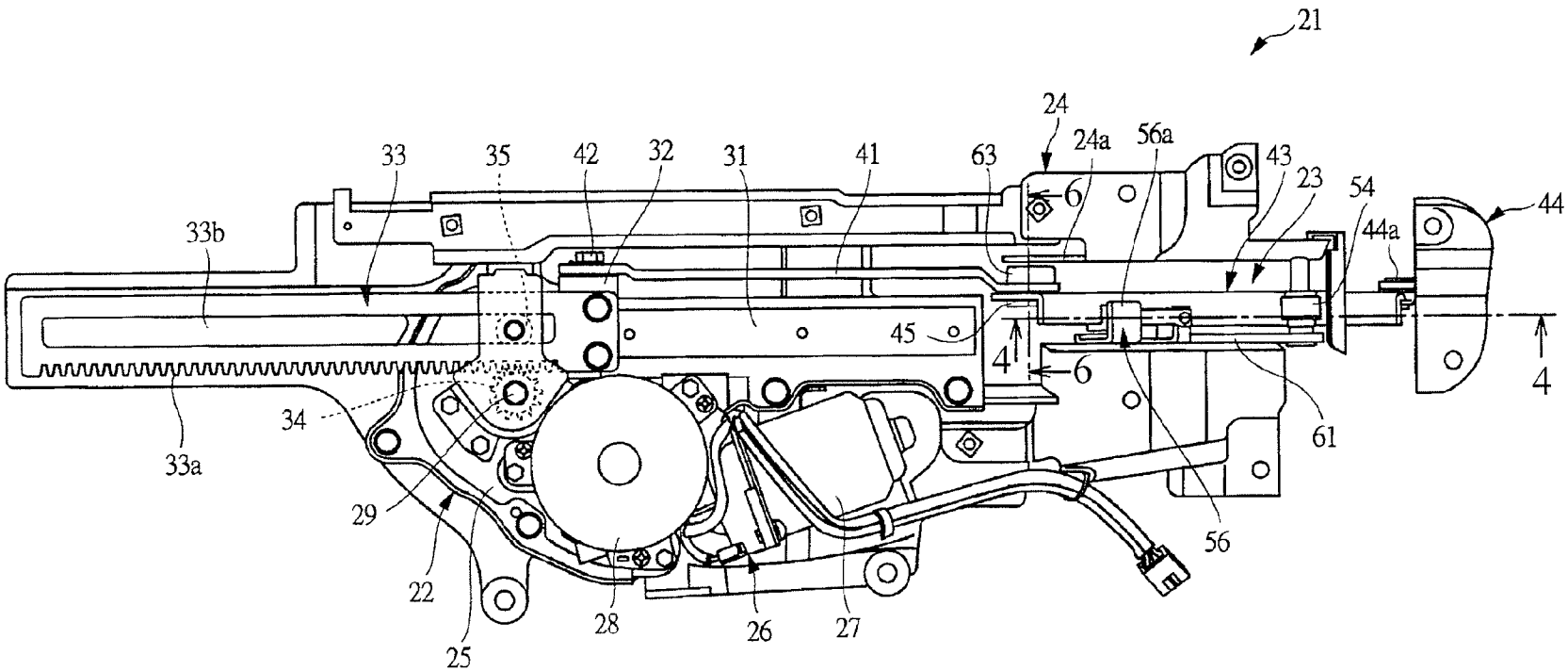
FIG. 3 is a schematic plan view of the automatic opening/closing apparatus of the vehicle of FIG. 2, illustrating it in greater detail.

FIG. 3 is a schematic plan view of the automatic opening/closing apparatus of the vehicle of FIG. 2, illustrating it in greater detail. The opening/dosing apparatus 21 comprises an actuator unit 22 and a link mechanism 23, of which the actuator unit 22 is rigidly secured to the inside of the roof 13 of the vehicle 11 by means of a fitting bracket 24.

The actuator unit 22 has a base 25 that is rigidly secured to the fitting bracket 24 and a drive unit 26 is fitted to the base 25. The drive unit 26 has an electric motor 27 that operates as drive source and the large number of revolutions per unit time of the electric motor 27 is reduced to a predetermined number of revolutions per unit time by a reduction gear 28 and output from an output shaft 29. The electric motor 27 is a so-called direct-current (DC) motor having a brush and its operation is controlled by a control unit (not shown). The control unit may typically be a microcomputer comprising a CPU and a memory that is adapted to output a control current to the electric motor 27 according to a command signal from a back door opening/dosing switch (not shown) typically arranged in the cabin of the vehicle so as to drive the electric motor 27 to turn forwardly or backwardly. Note, however, that the electric motor 27 is not limited to a DC motor with a brush and a brushless motor and the like may be used for it.

The drive unit 26 is provided with a friction type electromagnetic clutch (not shown) so that the power transmission between the electric motor 27 and the output shaft 29 can be activated or interrupted by means of the electromagnetic clutch. Thus, while the back door 12 is operated manually for opening and closing, the power supply to the electromagnetic clutch may be interrupted in order to reduce the force required to manually open and dose the back door 12. Note, however, that the friction type electromagnetic clutch may be replaced by a clutch mechanism of some other type.

A guide rail 31 is rigidly secured to the base 25 with its axial direction aligned to the moving direction of the vehicle. A rack 33 is fitted to the guide rail 31 by way of a slider 32. The slider 32 is movable along the guide rail 31 so that the rack 33 can linearly reciprocate in the moving direction of the vehicle. On the other hand, a pinion 34 is rigidly secured to the output shaft 29 and the rack teeth 33*a* formed on the rack 33 are held in engagement with the pinion 34. Thus, as the electric motor 27 is driven, the pinion 34 is driven to revolve to by turn drive the rack 33 to linearly reciprocate in the moving direction of the vehicle. In short, the actuator unit 22 is of the so-called rack and pinion type.

A guide groove 33*b* is formed on the rack 33 to extend in the moving direction of the vehicle. A guide pin 35 that is rotatably supported by the base 25 is inserted into the guide groove 33*b*. With this arrangement, the gap between the rack 33 and the pinion 34 is defined by the guide pin 35 in such a way that the rack 33 and the pinion 34 are reliably held in engagement with each other.

The slider 32 is connected to an end of a drive rod 41 that operates as output member by means of a pin member 42 in such a way that the drive rod 41 may freely swing up and down relative to the vehicle. In other words, as the drive rod 41 is connected to the rack 33 so as to be able to swing freely, it can be inclined freely relative to the vehicle 11. Thus, as the electric motor 27 is driven, the drive rod 41 is driven by the electric motor 27 with the rack 33 to reciprocate in the moving direction of the vehicle.

On the other hand, the link mechanism 23 has a link arm 43 that operates as link member and the force output from the actuator unit 22 is transmitted by way of the drive rod 41 and the link arm 43 to drive the back door to become opened or closed.

Figure 4:
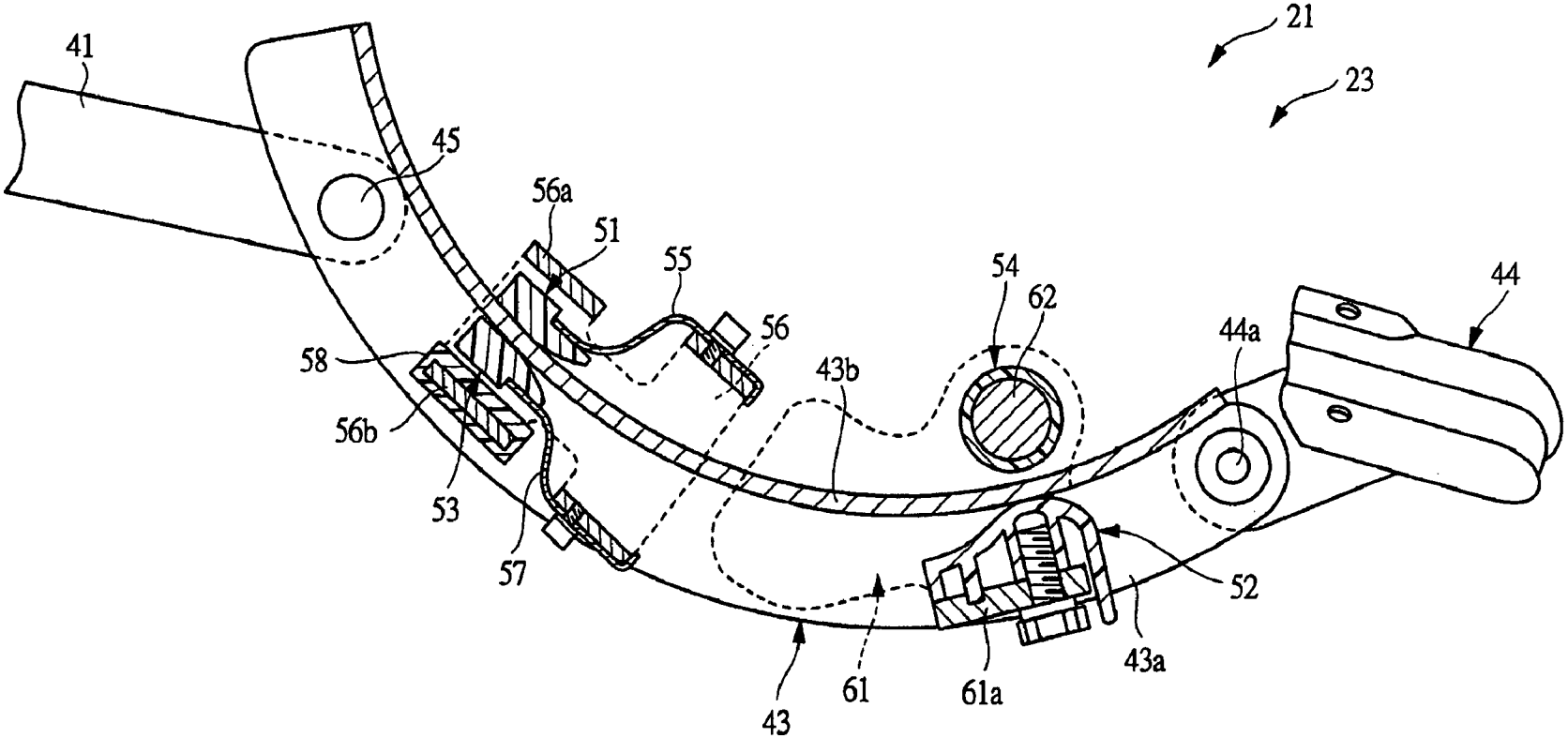
FIG. 4 is a schematic cross sectional view of the automatic opening/closing apparatus of FIG. 3 taken along line 4-4 in FIG. 3.
Figure 5:
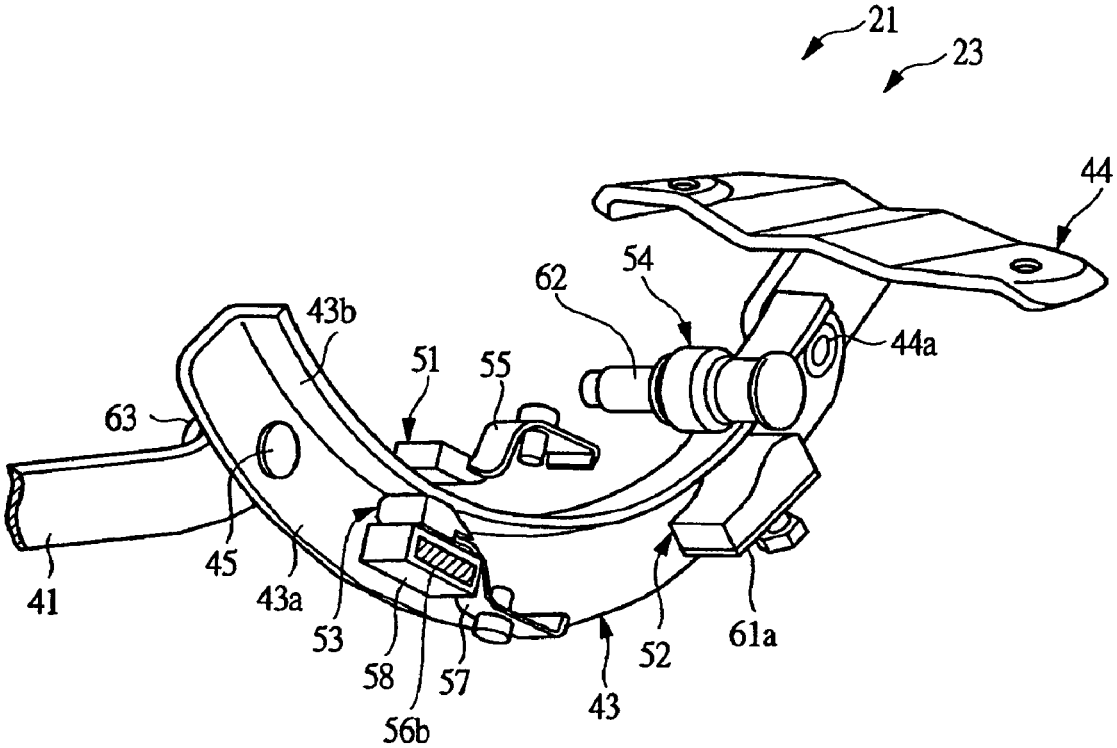
FIG. 5 is a schematic perspective view of the link mechanism shown in FIG. 4, illustrating it in greater detail.

FIG. 4 is a schematic cross sectional view of the automatic opening/closing apparatus of FIG. 3 taken along line 4-4, and FIG. 5 is a schematic perspective view of the link mechanism shown in FIG. 4, illustrating it in greater detail. Note that FIGS. 4 and 5 illustrate the link mechanism 23 when the back door 12 is fully opened.

Referring to FIG. 4, the link arm 43 shows an arm-shaped profile that is curved around the central axis 14*a* of revolution, around which the hinge 14 turns for opening and closing the back door 12. As seen from FIG. 5, the link arm 43 includes a base section 43*a* having a plane perpendicular to the axial direction of the central axis 14*a* of revolution and a flange section 43*b* that is bent rectangularly from the base section 43*a* to show a substantially L-shape in cross section.

The link arm 43 is linked at an end of the base section 43*a* thereof to the back door by way of a hinge bracket 44. As shown in FIG. 2, the hinge bracket 44 is rigidly secured to the back door. In other words, the link arm 43 is linked to the back door 12 in such a way that it can freely swing up and down around a pivot shaft 44*a* of the hinge bracket 44 relative to the back door 12 of the vehicle. Note that the pivot shaft 44*a* of the hinge bracket 44 is separated from the central axis 14*a* of revolution of the hinge 14 by a predetermined distance in a radial direction as seen from FIG. 2. The link arm 43 is linked at the other end of the base section 43*a* thereof to the other end of the drive rod 41 by means of a pin member 45. In other words, the link arm 43 and the drive rod 41 are linked to each other in such a way that they can swing up and down around the pin member 45 as viewed from the vehicle. With this arrangement, as the electric motor 27 is driven to reciprocate the drive rod 41, the output force of the drive rod 41 is transmitted to the back door 12 by way of the link arm 43. Thus, the back door 12 is driven to turn and become opened or dosed as the drive rod 41 is reciprocated by the electric motor 27.

Referring to FIGS. 4 and 5, the link mechanism 23 is provided with a pair of open side support sliders 51, 52 and a closed side support slider 53 and a closed side supporting roller 54 so that the load around the pivot shaft 44*a* of the link arm 43 is supported by these members to by turn support the link arm 43 in the moving direction.

When the back door 12 is fully opened, the open side support slider 51 that operates as a first open side support member is located at the side of the electric motor 27 and hence at the front side of the vehicle relative to the link arm 43 and, at the same time, at a side of the swinging direction relative to the flange section 43*b* or at the inner peripheral side of the link arm 43. The open side support slider 51 is made of a low friction resin material and fitted to an end of a leaf spring member 55, the other end of the leaf spring member 55 being rigidly secured to the vehicle 11 by way of a stay 56 and the fitting bracket 24. With this arrangement, the open side support slider 51 that operates as a press member is held in contact with the flange section 43*b* while it urges the link arm 43 downward as viewed from the vehicle by the spring force of the leaf spring member 55. In other words, it is pressed against the flange section 43*b*. The stay 56 is provided with a limiting wall 56*a* located vis-à-vis the rear surface of the open side support slider 51 so that the moving stroke of the open side support slider 51 is limited by the limiting wall 56*a* when it moves away from the link arm 43. When the back door 12 is driven to become open by the actuator unit 22 and the pivot shaft 44*a* that links the link arm 43 to the back door 12 is located below the axial line of the drive rod 41 (the line that passes through the shaft of drive rod 41 from the center of the pin member 42 to the center of the pin member 45) as viewed from the vehicle, the open side support slider 51 is supported by the limiting wall 56*a* to by turn support the load being applied to the link arm 43. Thus, when the electric motor 27 operates to open the back door 12, the acting direction of the force being applied to the link arm 43 by way of the drive rod 41 is shifted to the opening direction of the back door 12 by the open side support slider 51.

On the other hand, a dosed side support slider 53 that operates as a first closed side support member is arranged at the outer peripheral side relative to the flange section 43*b* and located vis-à-vis the open side support slider 51 with the flange section 43*b* of the link arm 43 interposed between them. The dosed side support slider 53 is made of a low friction resin material and fitted to an end of a leaf spring member 57, the other end of the leaf spring member 57 being rigidly secured to the vehicle 11 by way of the stay 56. With this arrangement, the closed side support slider 53 that operates as a press member is held in contact with the flange section 43*b* while ft urges the link arm 43 upward as viewed from the vehicle by the spring force of the leaf spring member 57. In other words, ft is pressed against the flange section 43*b*. The stay 56 is provided with a limiting wall 56*b* located vis-à-vis the rear surface of the closed side support slider 53 so that the moving stroke of the closed side support slider 53 is limited by the limiting wall 56*b* when ft moves away from the link arm 43. Reference symbol 58 denotes a spacer fitted to the limiting wall 56*b* and the moving stroke of the closed side support slider 53 that is limited by the limiting wall 56*b* can be adjusted by the spacer 58. When the back door 12 is driven to become closed by the actuator unit 22 and the pivot shaft 44*a* is located below the axial line of the drive rod 41 as viewed from the vehicle, the dosed side support slider 53 is supported by the limiting wall 56*b* by way of the spacer 58 to by turn support the load being applied to the link arm 43. Thus, when the electric motor 27 operates to close the back door 12, the acting direction of the force being applied to the link arm 43 by way of the drive rod 41 is shifted to the closing direction of the back door 12 by the dosed side support slider 53.

As described above, when the back door 12 is at the fully dosed position, both the open side support slider 51 and the closed side support slider 53 that face each other with the link arm 43 interposed between them press the link arm 43 toward the other slider by the spring force of the respective leaf spring members 55, 57. More specifically, the link arm 43 is pressed against the closed side support slider 53 by the open side support slider 51 and also pressed against the open side support slider 51 by the dosed side support slider 53. As a result, when the back door 12 is at the fully closed position, the link arm 43 is sandwiched by the sliders 51, 53 and held to a neutral position where neither the slider 51 nor the slider 53 are supported by the respective liming walls 56*a*, 56*b*.

Open side support slider 52 that operates as a second open side support member is made of a low friction resin material and arranged at the other side of the swinging direction relative to the flange section 43*b* at the side of the back door 12 relative to the open side support slider 51 and at the outer peripheral side of the link arm 43. It is rigidly secured to the vehicle 11 by way of a fitting section 61*a* of a plate 61 that is rigidly secured to the fitting bracket 24. When the back door 12 is driven to become open by the actuator unit 22 and the pivot shaft 44*a* is located above the axial line of the drive rod 41 as viewed from the vehicle, the open side support slider 52 supports the load being applied to the link arm 43. Thus, when the electric motor 27 operates to open the back door 12, the acting direction of the force being applied from the electric motor 27 to the link arm 43 by way of the drive rod 41 is vertically inverted as viewed from the vehicle, the acting direction of the force is shifted to the opening direction of the back door 12 by the open side support slider 52.

In other words, when the back door 12 is driven to move from the fully closed position to the fully open position by the electric motor 27, the acting direction of the force being applied to the link arm 43 by way of the drive rod 41 is inverted from the direction of turning the link arm 43 upward as viewed from the vehicle around the pivot shaft to the direction of turning the link arm 43 downward as viewed from the vehicle when the axial direction of the drive rod 41 comes to agree with the axial direction of the link arm 43 (the direction of the line that passes through the pin member 45 and the pivot shaft 44*a*). Therefore, the open side support sliders 51, 52 for supporting the load of the link arm 43 are arranged respectively at the inner peripheral side and at the outer peripheral side of the flange section 43*b* to accommodate the inversion.

Closed side support roller 54 that operates as a second closed side support member is made of a metal material and arranged at the inner peripheral side relative to the flange section 43*b*. In other words, it is arranged vis-à-vis the open side support slider 52 with the flange section 43*b* of the link arm 43 interposed between them. The closed side support roller 54 is supported by a rotary shaft 62 arranged at a plate 61 so as to be able to freely revolve. Thus, the closed side support roller 54 can freely revolve relative to the link arm 43. When the back door 12 is driven to become closed by the actuator unit 22 and the pivot shaft 44*a* is located above the axial line of the drive rod 41 as viewed from the vehicle, the dosed side support roller 54 supports the load being applied to the link arm 43. The closed side support roller 54 is provided on the roller surface thereof with a rubber member for efficiently supporting the link arm 43. With this arrangement, when the acting direction of the force being applied from the electric motor 27 to the link arm 43 by way of the drive rod 41 is inverted vertically as viewed from the vehicle while the electric motor 27 operating to close the back door 12, it is shifted by the dosed side support roller 54 to the direction effective for dosing the back door 12.

In other words, when the back door 12 is driven to move from the fully open position to the fully closed position by the electric motor 27, the acting direction of the force being applied to the link arm 43 by way of the drive rod 41 is inverted from the direction of turning the link arm 43 upward as viewed from the vehicle around the pivot shaft to the direction of turning the link arm 43 downward as viewed from the vehicle when the axial direction of the drive rod 41 comes to agree with the axial direction of the link arm 43. Therefore, the closed side support sliders 53 and the dosed side support roller 54 are arranged respectively at the outer peripheral side and at the inner peripheral side of the flange section 43*b* to support the load of the link arm 43.

The open side support slider 52 and the dosed side support roller 54 are separated by a gap that is slightly greater than the thickness of the flange section 43*b* of the link arm 43 so that the link arm 43 can slightly vertically move as viewed from the vehicle around the pivot shaft 44*a* between the open side support slider 52 and the closed side support roller 54. This arrangement is permissible because the sliders 51 through 53 and the roller 54 are adapted to support the load of the link arm 43 and define the acting direction thereof but not constantly held in contact with the link arm 43 to guide the link arm 43 for movement.

Figure 6:
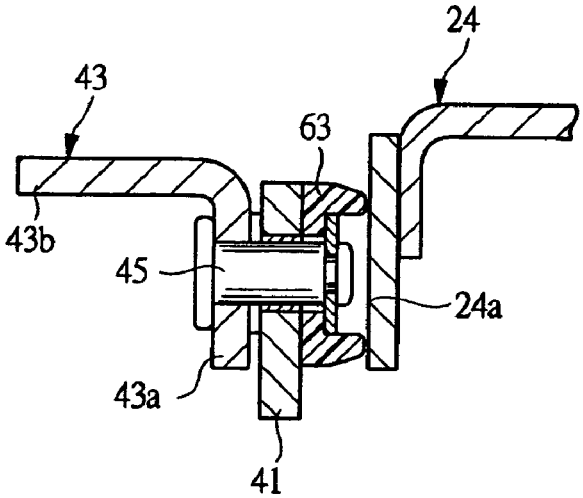
FIG. 6 is a schematic cross sectional view of the automatic opening/closing apparatus of FIG. 3 taken along line 6-6 in FIG. 3.

FIG. 6 is a schematic cross sectional view of the automatic opening/closing apparatus of FIG. 3 taken along line 6-6 in FIG. 3. Referring to FIG. 6, a cylindrical supporter 63 is fitted to the link section of the drive rod 41 and the link arm 43 and supported by the pin member 45. The movement of the link arm 43 in the lateral direction of the vehicle is restricted because the supporter 63 frictionally slides on the support surface 24*a* that is formed on the fitting bracket 24.

Figure 7A:
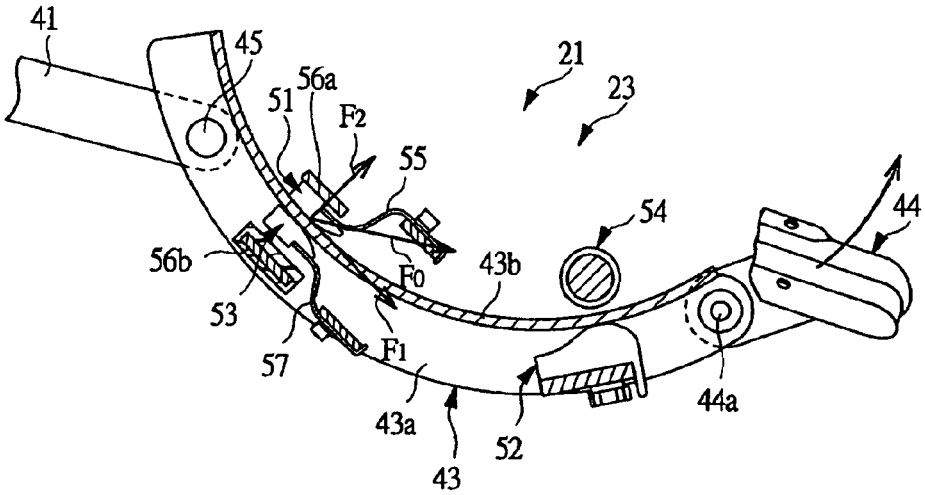
FIG. 7A is a schematic illustration of the operation of the link mechanism when the back door is being opened.
Figure 7B:
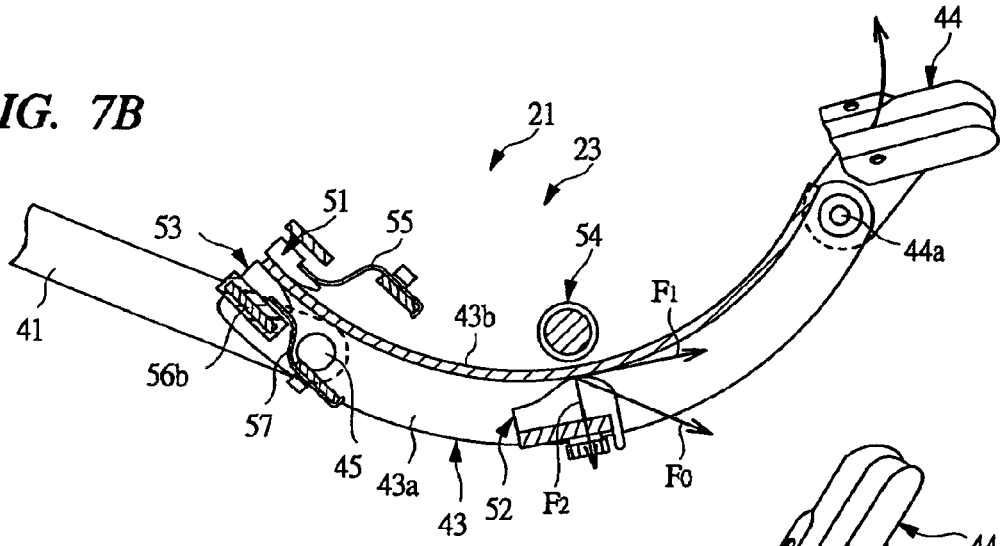
FIG. 7B is a schematic illustration of the operation of the link mechanism when the back door is being opened.
Figure 7C:
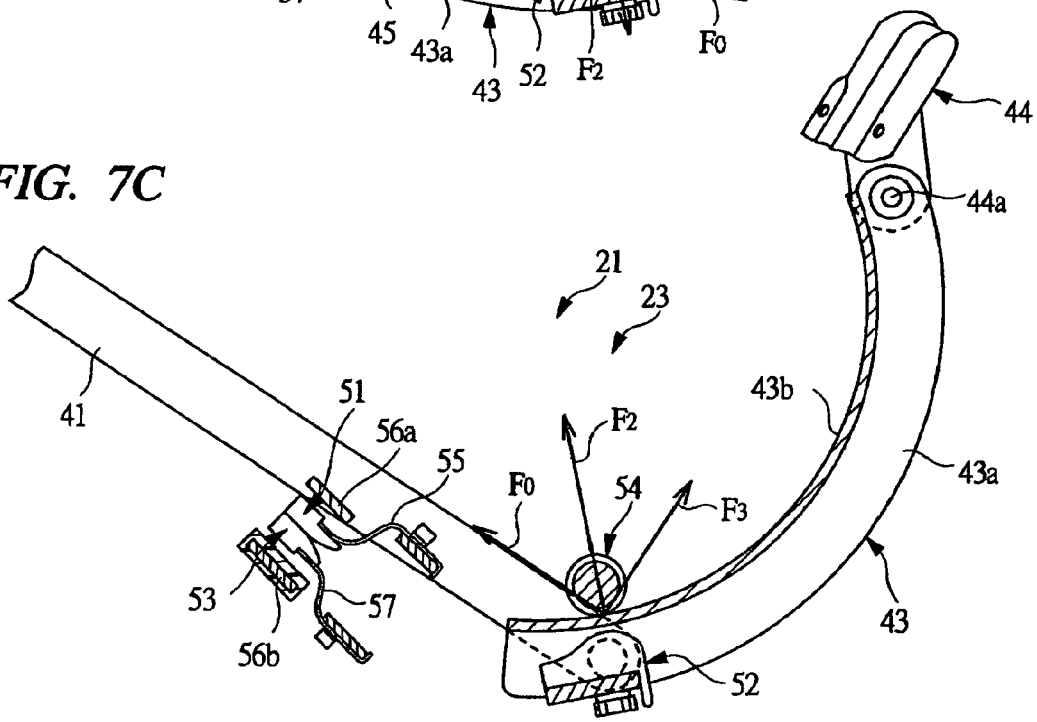
FIG. 7C is a schematic illustration of the operation of the link mechanism when the back door is being opened.
Figure 8A:
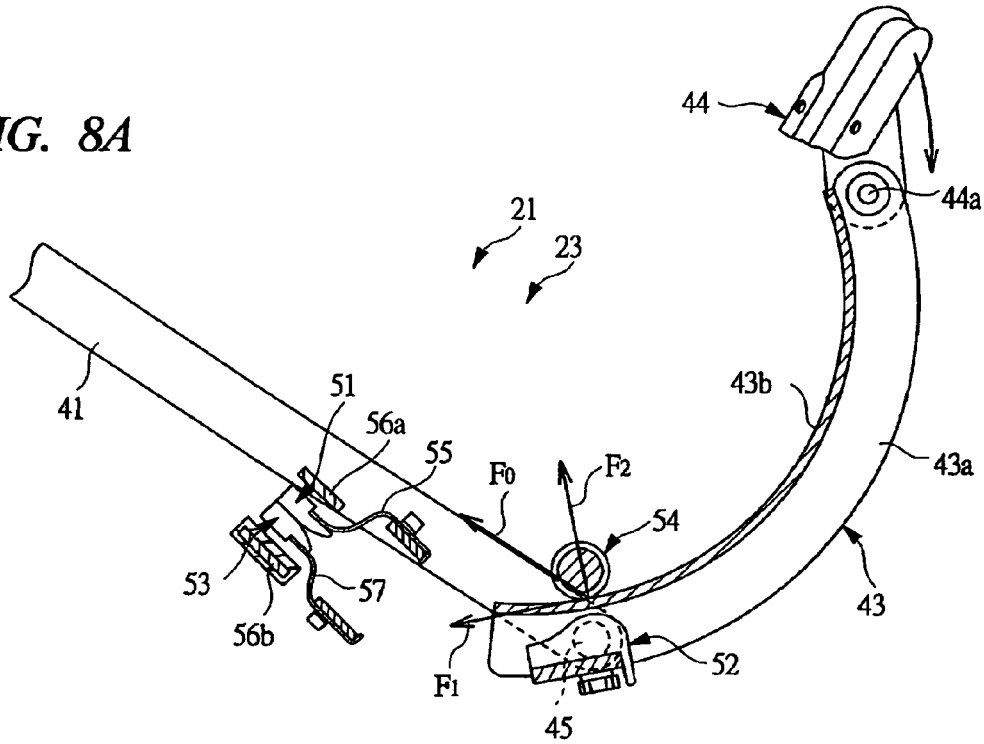
FIG. 8A is a schematic illustration of the operation of the link mechanism when the back door is being dosed.
Figure 8B:
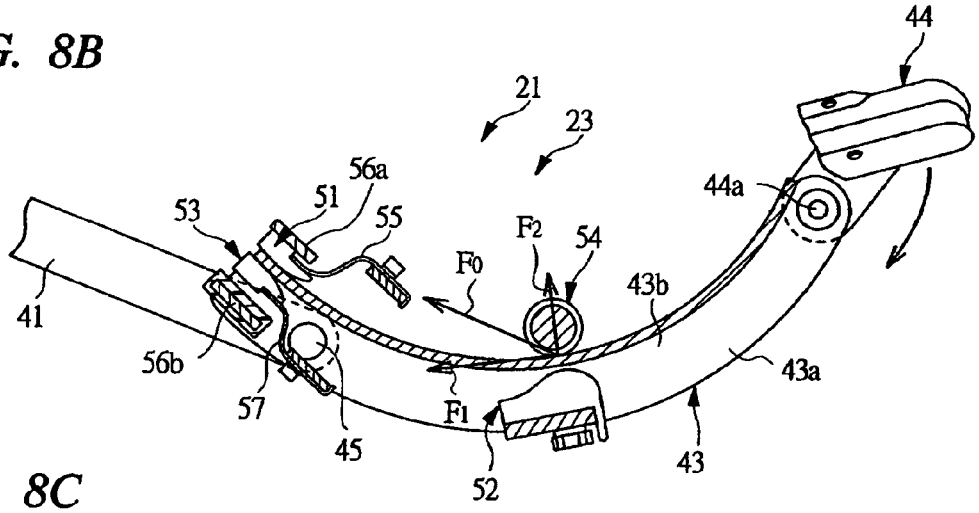
FIG. 8B is a schematic illustration of the operation of the link mechanism when the back door is being dosed.
Figure 8C:
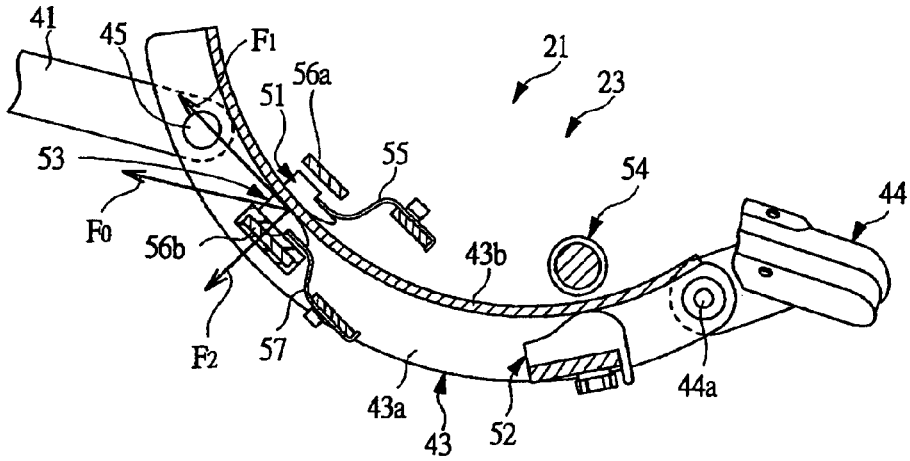
FIG. 8C is a schematic illustration of the operation of the link mechanism when the back door is being dosed.

FIGS. 7A through 7C are schematic illustrations of the operation of the link mechanism when the back door is being opened and FIGS. 8A through 8C are schematic illustrations of the operation of the link mechanism when the back door is being dosed. Now, the operation of the link mechanism 23 will be described below by referring to FIGS. 7A through 8C.

Referring firstly to FIG. 7A, when the link arm 43 is located at the position for fully closing the back door 12 and a back door opening/dosing switch (not shown) is turned to the opening side, the electric motor 27 is driven to move the drive rod 41 toward the back door 12. As the drive rod 41 is operated, the link arm 43 is driven to turn upward as viewed from the vehicle around the pivot shaft 44*a* by the force $F_0$ exerted by the electric motor 27 so that the open side support slider 51 moves against the urging force of the leaf spring member 55 until it abuts the liming wall 56*a*. As the open side support slider 51 abuts the limiting wall 56*a*, the force $F_0$ is divided into force $F_1$ that is directed to the opening direction of the back door 12 and load $F_2$ that is supported by the open side support slider 51. In other words, as the force $F_0$ is applied to the link arm 43 from the drive rod 41, the force $F_0$ of the electric motor 27 that is applied to the link arm 43 is converted into the force $F_1$ that is directed to the opening direction of the back door 12 as the load $F_2$ that is applied to the link arm 43 is supported by the open side support slider 51. Thus, the link arm 43 is driven to turn around the central axis 14*a* of revolution of the hinge 14 by the electric motor 27 so that it operates to open the back door 12 while sliding on the open side support slider 51.

Then, as the back door 12 is opened by a predetermined angle as shown in FIG. 17B, the acting direction of the load $F_2$ produced from the force $F_0$ that is being applied to the link arm 43 is inverted to turn the latter downward around the pivot shaft 44*a* as viewed from the vehicle. Thus, the link arm 43 is turned downward around the pivot shaft 44*a* and the load $F_2$ is supported by the closed side support slider 53. The force $F_0$ that is being applied to the link arm 43 by the electric motor 27 is converted into force $F_1$ by the open side support slider 52 to open the back door 12 and the link arm 43 operates to further open the back door 12, while sliding on the open side support slider 52. Note that the closed side support slider 53 is also held in contact with the link arm 43 and supports the load $F_2$ in this stage of operation, it may alternatively be so arranged as not to support the link arm 43 at all.

When the back door 12 gets to the fully open position, the electric motor 27 is stopped and the operation of opening the back door 12 is terminated. At this time, as shown in FIG. 7C, the force $F_0$ from the drive rod 41 is applied to the link arm 43 as braking force for the back door 12 and the back door 12 is held to the fully open position while it is being urged to the opening direction by the urging force $F_3$ of the gas stay 15. Thus, the link arm 43 is halted while load $F_2$ that is produced by the force $F_0$ from the drive rod 41 and the urging force $F_3$ of the gas stay 15 is supported by the dosed side support roller 54.

In this way, when the back door 12 is driven by the electric motor 27 in the opening direction to turn and get to the open position, the load $F_2$ that is applied around the pivot shaft 44*a* to the link arm 43 is supported by the open side support sliders 51, 52 and the force $F_0$ of the electric motor 27 is converted into the force $F_1$ for turning the back door 12 in the opening direction to consequently open the back door 12.

On the other hand, when the back door 12 is driven by the electric motor 27 to turn and move from the fully open position to the fully dosed position, firstly the drive rod 41 moves away from the back door 12 and accordingly the link arm 43 is driven to turn upward around the pivot shaft 44*a* as viewed from the vehicle in a manner as shown in FIG. 8A. Then, the load $F_2$ being applied to the link arm 43 is supported by the dosed side support roller 54 so that consequently the force $F_0$ that is being applied to the link arm 43 from the electric motor 27 by way of the drive rod 41 is converted into the force $F_1$ for turning the back door 12 in the closing direction. Thus, the link arm 43 is driven to turn around the central axis 14*a* of revolution of the hinge 14 by the electric motor 27 to consequently turn the back door 12 to close the latter while turning the closed side support roller 54.

Then, as the back door 12 is closed by a predetermined angle as shown in FIG. 8B, the link arm 43 is pinched between the open side support slider 51 and the dosed side support slider 53. Since the sliders 51, 53 are made to show respective profiles that are curved toward the back door 12 so as to increase the distance separating them from each other, the flange section 43*b* of the link arm 43 can be easily pinched between the sliders 51, 53.

Then, when the opening of the back door 12 falls below a predetermined angle as shown in FIG. 8C, the acting direction of the load $F_2$ that is produced by the force $F_1$ being applied to the link arm 43 by the drive rod 41 is inverted so as to turn the link arm 43 downward as viewed from the vehicle around the pivot shaft 44*a*. Then, the link arm 43 presses the closed side support slider 53 and thus slider 53 abuts the limiting wall 56*b*. As the closed side support slider 53 abuts the limiting wall 56*b*, the load $F_2$ that is being applied to the link arm 43 is supported by the closed side support slider 53 so that consequently the force $F_0$ of the electric motor 27 that is being applied to the link arm 43 by way of the drive rod 41 is converted into the force $F_1$ that is directed to the closing direction of the back door 12. Therefore, the link arm 43 is driven to turn around the central axis 14*a* of revolution of the hinge 14 by the electric motor 27 to turn and close the back door 12 while it is sliding on the closed side support slider 53. When the back door 12 gets to the fully closed position, the electric motor 27 is stopped and the operation of dosing the back door 12 is terminated.

As described above, when the back door 12 is driven by the electric motor 27 to turn and move in the closing direction, the load $F_2$ that is applied around the pivot shaft 44*a* to the link arm 43 is supported by the dosed side support slider 53 and the closed side support roller 54 and the force $F_0$ of the electric motor 27 is converted into the force $F_1$ for turning the back door 12 in the dosing direction to consequently close the back door 12.

With the above described opening/closing apparatus 21, the open side support slider 51 and the closed side support slider 53 are pressed against the link arm 43 while the back door 12 is held to the fully closed position so that the link arm 43 does not give rise to any noise that can be generated when the link arm 43 oscillates between the sliders 51, 53 to strike them even when the vehicle 11 is running. In other words, the link arm 43 is linked at the opposite ends thereof respectively to the back door 12 and the drive rod 41 so as to be able to swing freely and movable up and down as viewed from the vehicle around the pivot shaft 44*a* to an extent equal to the backlash of the engagement of the rack teeth 33*a* of the rack 33 and the pinion 34 when the back door 12 is at the fully closed position but the link arm 43 is prevented from oscillating between the sliders 51, 53 because the latter are urged toward the link arm 43 respectively by the leaf spring members 55, 57 and held in contact with the link arm 43.

While both of the sliders 51, 53 are urged toward the link arm 43 respectively by the leaf spring members 55, 57 so as to hold the link arm 43 to the neutral position in the illustrated embodiment, the present invention is not limited to such an arrangement. Alternatively, for example, it may be so arranged that the spring force of either the leaf spring member 55 urging the slider 51 or that of the leaf spring member 57 urging the slider 53 is made greater than the other so that either of the sliders 51, 53 presses the link arm 43 in such a way that the sliders 51, 53 are supported by the respective limiting walls 56*a*, 56*b*. Still alternatively, it may be so arranged that only either the slider 51 or the slider 53 is urged by the leaf spring member 55 or the leaf spring member 57, whichever appropriate, to press the link arm 43 against the slider 53 or the slider 51, whichever appropriate. With either arrangement, the link arm 43 is pressed against the sliders 51, 53 so that it is prevented from oscillating between the sliders 51, 53.

As described above in detail, with the opening/dosing apparatus 21, the link arm 43 is pressed against the open side support slider 51 and the closed side support slider 53 when the back door 12 is at the fully closed position so that the link arm 43 is prevented from oscillating between the sliders 51, 53. Therefore, the link arm 43 does not give rise to any noise that can be generated when the link arm 43 oscillates between the sliders 51, 53 to strike them.

Figure 9:
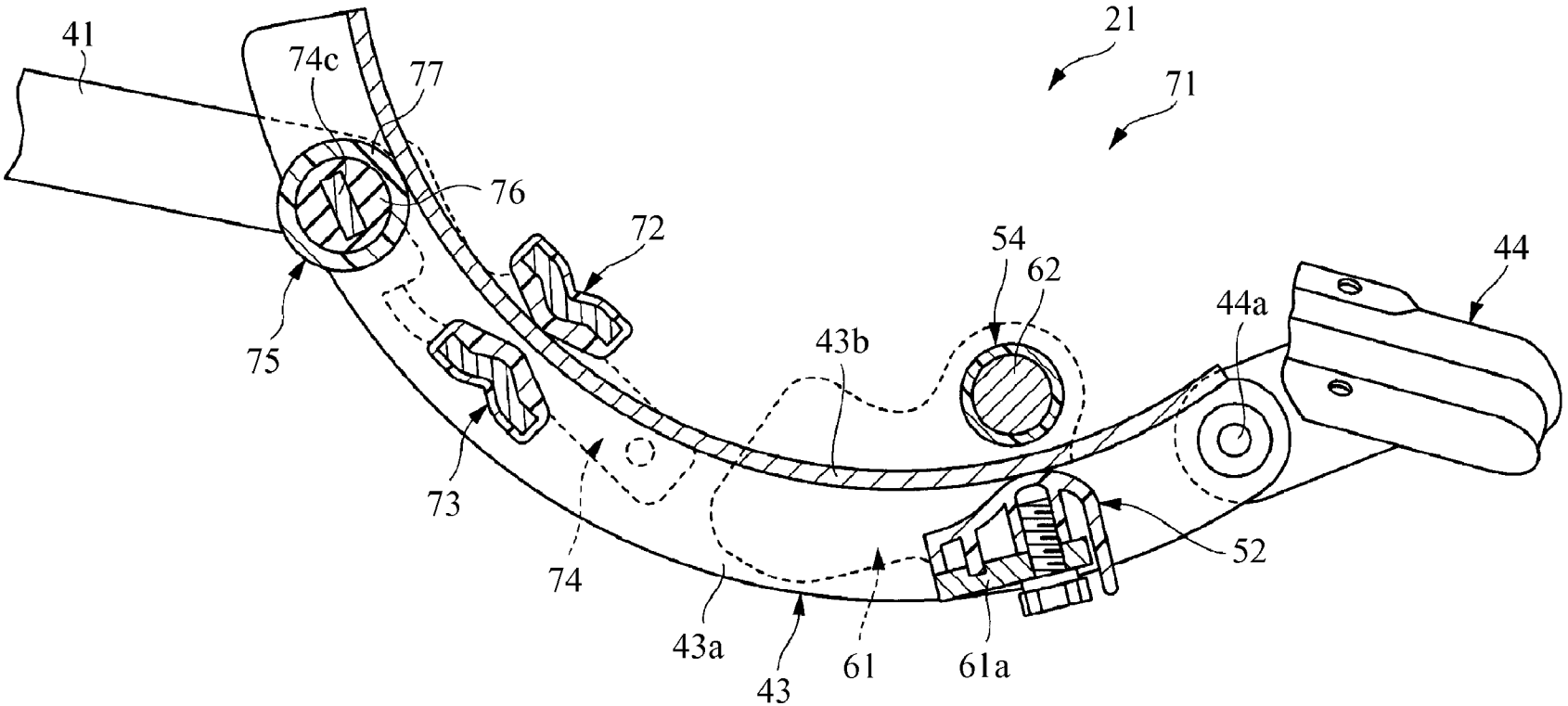
FIG. 9 is a schematic cross sectional view of a link mechanism realized by modifying that of FIG. 4.

FIG. 9 is a schematic cross sectional view of a link mechanism realized by modifying that of FIG. 4. In FIG. 9, the components that correspond to the respective components of the above described embodiment are denoted by the same reference symbols.

Referring to FIG. 9, in the link mechanism 71, the open side support slider 72 and the closed side support slider 73 are arranged vis-à-vis with the link arm 43 interposed between them and rigidly secured to the stay 74 and hence to the vehicle 11. The flange section 43*b* of the link arm 43 is separated from the sliders 72, 73 by a small gap and hence the link arm 43 is not urged by the sliders 72, 73.

On the other hand, the link mechanism 71 is provided with a press member 75 that is brought to contact the flange section 43*b* from the outer periphery thereof at the side of the electric motor 27 relative to the closed side support slider 73. The press member 75 includes a resilient body 76 (e.g., made of rubber) showing a circular cross section and a hollow cylindrical ring member 77 made of resin, of which the ring member 77 is arranged to tightly surround the resilient body 76 and securely held in position. The resilient body 76 is supported by a support projection 74*c* arranged on the stay 74 so as to be rigidly secured to the vehicle 11.

When the back door 12 is at the fully closed position, the flange section 43*b* of the link arm 43 is held in contact with the outer peripheral surface of the ring member 77 with the resilient body 76 held in a resiliently deformed state. With this arrangement, when the back door 12 is brought to the fully closed position, the link arm 43 is urged upward around the pivot shaft 44*a* by the resilient force of the resilient body 76 as viewed from the vehicle so that consequently the link arm 43 is pressed against the open side support slider 72. Additionally, since the press member 75 has a cylindrical outer profile, if the back door 12 is opened and the link arm 43 is separated from the press member 75, the flange section 43*b* of the link arm 43 is guided by the outer surface of the ring member 77 and smoothly becomes engaged with the press member 75 when the back door 12 is turned back again to the fully closed position.

The press member 75 is rigidly secured to the support projection 74*c* and the link arm 43 slides on the outer periphery of the ring member 77 when the back door 12 is turned in the opening direction or the closing direction in the illustrated instance. However, the present invention is by no means limited thereto and it may alternatively be so arranged that the press member 75 is fitted to the stay 74 in such a way that it can freely revolve. Additionally, the link arm 43 that is urged by the press member 75 is pressed against the open side support slider 72 in the illustrated instance. However, the present invention is by no means limited thereto and it may alternatively be so arranged that the link arm 43 is pressed against the closed side support roller 54 or against both the open side support slider 72 and the closed side support roller 54. Still additionally, the press member 75 is adapted to urge the link arm 43 upwardly from the pivot shaft 44*a* as viewed from the vehicle by the resilient force of the resilient body 76 in the illustrated in stance. However, the present invention is by no means limited thereto and it may alternatively be so arranged that the press member 75 is arranged at the inner peripheral side of the flange section 43*b* and adapted to urge the link arm 43 downwardly from the pivot shaft 44*a* as viewed from the vehicle and press the link arm 43 against the closed side support slider 53 or the open side support slider 52 or against both the sliders 52 and 73 at the same time.

As pointed out above, with the link mechanism 71, the link arm 43 is pressed against the open side support slider 72 by the press member 75 when the back door 12 is at the fully closed position. Therefore, the link arm 43 does not give rise to any noise that can be generated when the link arm 43 oscillates between the sliders 72, 73 to strike them when the back door 12 is at the fully closed position.

Additionally, the press member 75 is arranged at the side of the electric motor 75 relative to the closed side support slider 73, the link arm 43 is reliably pressed against the open side support slider 72.

The present invention is by no means limited to the above-described embodiment, which may be modified or altered without departing from the scope of the present invention. For example, while the opening/closing member is the back door 12 that is mounted to the rear end of the vehicle 11 and can be freely turned up and down for opening and closing, the present invention is by no means limited thereto and the opening/closing member may be a horizontal swing door or some other opening/dosing member.

While the actuator unit 22 is rigidly secured to the inside of the roof 13 of the vehicle 11 in the above embodiment, the present invention is by no means limited thereto and it may alternatively be arranged in the inside of a pillar of the vehicle 11. Then, the rack 33 may be made to freely reciprocate substantially in a vertical direction relative to the vehicle 11.

While the linear reciprocating motion of the rack 33 is transmitted to the link arm 43 by way of the drive rod 41 in the above embodiment, the present invention is by no means limited thereto and the rack 33 may alternatively be made to be able to freely swing around the output shaft 29 to which the pinion 34 is rigidly secured so that the link arm 43 may be directly linked to the rack 33 so as to be able to freely swing.

While a gas stay 15 is arranged between the vehicle 11 and the back door 12 in the above embodiment, it is a part that is appropriately selected depending on the type of the vehicle. In other words, a hydraulic stay may be arranged or no stay may be arranged for the purpose of the invention depending on the type of the vehicle.

While a metal made roller 54 is used as the second dosed side support member in the above embodiment, the present invention is by no means limited thereto and a slider made of a low friction resin material like the other open side support members and the other closed side support member may alternatively be used.

Finally, the profiles and the materials of the support members 51 through 54 are not limited to those of the above embodiment. In other words, they may be appropriately selected depending on the length and the profile of the link arm 43, the type of the vehicle, the weight of the back door 12 and other factors.

What is claimed is:

1. An automatic opening and closing apparatus for a vehicle that automatically opens and closes an opening and closing member attached to the vehicle by way of a hinge, the apparatus comprising:

a link member linked to the opening and closing member at a first end of the link member so as to be able to freely swing relative to the opening and closing member;

an output member linked to a second end of the link member so that the output member is able to freely swing relative to the link member;

a drive source which drives the output member to reciprocate for opening and closing the opening and closing member;

an open side support member bearing a load applied to the link member when the opening and closing member is driven open by the drive source and shifting an acting direction of a force being applied to the link member by the drive source to an opening direction of the opening and closing member;

a closed side support member bearing a load applied to the link member when the opening and closing member is driven closed by the drive source and shifting an acting direction of a force being applied to the link member by the drive source to a closing direction of the opening and closing member;

a first leaf spring member pressing the open side support member to the link member and pressing the link member to the closed side support member when the opening and closing member is in a fully closed position; and a second leaf spring member pressing the closed side support member to the link member and pressing the link member to the open side support member when the opening and closing member is in the fully closed position;

wherein the open side support member is a first open side support member and is arranged on a first side of the link member as viewed in a swinging direction of the link member; the closed side support member is a first closed side support member and is arranged opposite to the first open side support member with the link member interposed between the two support members; a second open side support member is arranged closer to the opening and closing member relative to the first open side support member and at a second side of the link member opposite to the first side of the link member as viewed in the swinging direction of the link member; and a second closed side support member is arranged opposite to the second open side support member with the link member interposed between the latter two support members, wherein at least one of the second open side support member and the second closed side support member is not pressed to the link member by a leaf spring member.

2. The automatic opening and closing apparatus for a vehicle according to claim 1, wherein the link member has a curved profile.

* * * * *